United States Patent [19]

Smith

[11] 4,445,980

[45] May 1, 1984

[54] COPPER ELECTROPLATING PROCEDURE

[75] Inventor: Craig G. Smith, North Plainfield, N.J.

[73] Assignee: Bell Telephone Laboratories, Incorporated, Murray Hill, N.J.

[21] Appl. No.: 526,480

[22] Filed: Aug. 25, 1983

[51] Int. Cl.[3] ..... C25D 5/02; C25D 3/38; C25D 17/00

[52] U.S. Cl. ..... 204/15; 204/52 R; 204/231

[58] Field of Search ..... 204/14 R, 15, 52 R, 204/231

[56] References Cited

U.S. PATENT DOCUMENTS

| | | | |
|---|---|---|---|
| 1,465,034 | 8/1923 | Antisell | 204/231 |
| 1,534,709 | 4/1925 | Holt | 204/52 R |
| 3,573,193 | 3/1971 | Powers | 204/52 R |
| 4,269,670 | 5/1981 | Smith | 204/15 |
| 4,310,391 | 1/1982 | Okinaka et al. | 204/46 G |

OTHER PUBLICATIONS

"The Application of Pulsed Plating Techniques to Metal Deposition", *Plating,* 61, C. C. Wan et al., 1974, p. 559.

"Periodic Reverse Current Process in Electroplating Using Acid Copper Electrolytes", *Transactions of the Institute of Metal Finishing,* 56, J. Mann, 1978, pp. 70–74.

"PR Copper Cyanide Plating of Printed Wiring Boards", *Plating,* 59, H. L. Pinkerton et al., 1972, pp. 672–676.

*Primary Examiner*—T. M. Tufariello

*Attorney, Agent, or Firm*—Walter G. Nilsen

[57] ABSTRACT

In traditional copper electroplating processes, soluble copper anodes are used as the source of copper. There are certain potential advantages to using nonconsumable anodes and adding a source of copper such as copper oxide to replenish the electroplating bath. Periodic reverse current plating is used by some manufacturers to obtain smoother deposits without the use of additives. This periodic reversal of current drastically reduces the service life of the nonconsumable anodes because of dissolution of the metal oxide on the insoluble anode. The invention is a copper electroplating process with a dual-element anode assembly. This assembly consists of electrically isolated copper and metal-oxide electrodes. The metal-oxide electrode is active only during the anodic part of the cycle while the copper electrode is active only during the cathodic part of the cycle. Electrical isolation is achieved by the use of diodes or relays.

11 Claims, 3 Drawing Figures

COPPER ELECTROPLATING PROCEDURE

TECHNICAL FIELD

The invention is a process for electroplating copper using nonconsumable electrodes.

BACKGROUND OF THE INVENTION

Many manufacturing processes involve the electroplating of copper on various surfaces including metal and conducting surfaces. Such copper platings are used to prevent corrosion, to increase electrical conductivity or thermal conductivity, and to serve as an adherent layer for additional metallic layers. Recently, such activity with regard to copper electroplating has been associated with the production of various electronic circuits and devices including circuit boards, integrated circuits, electrical contact surfaces, etc.

Traditional electroplating processes for copper involve the use of consumable counterelectrodes (or anodes). Here, the counterelectrode is made of metallic copper which is oxidized to soluble copper ions during the electroplating process. The counterelectrodes serve not only as the anode in the electroplating process but also as a source of copper ions in the electroplating bath to replace the copper ions consumed in the electroplating process at the cathode.

The copper electroplating process described in the instant application involves use of nonconsumable counterelectrodes or anodes. Such processes are advantageous because of potentially higher plating rates, better control of bath chemistry, smaller size of the plating apparatus and use of various copper salts (such as copper oxide) as sources of copper in the electroplating process. These copper salts are often readily available from etching procedures in the manufacture of various items including electronic circuit boards.

There are other advantages in the use of nonconsumable electrodes in copper electroplating. For example, geometry remains very constant so that there is better control of plating characteristics (plating rate, thickness, etc.) than in the case of consumable electrodes where electrode size and shape are constantly changing. Also, the copper electroplating process need not be interrupted to change electrodes if nonconsumable electrodes are used.

A particular difficulty in all copper electroplating is obtaining copper films of sufficient quality for a particular application. For example, in electrical applications, it is desirable to have ductile, smooth bright copper films with high electrical conductivity. Smooth films of uniform thickness are also highly desirable.

These desirable qualities of copper made by electroplating are usually obtained by the use of additives to the copper electroplating bath. The use of such additives improves brightness, improves the physical properties of the copper plating such as ductility, and increases micro-throwing power of the bath. Although this procedure often works quite well, it is under certain circumstances desirable to simplify the composition of the bath. For example, additives might decompose rapidly or use of additives might be inconvenient under certain circumstances.

Periodic reversal of current in the copper electroplating process is also known to improve the quality of copper platings and often permits more rapid electroplating of copper without degradation of plating quality (see the following references: C. C. Wan et al, *Plating*, 61, 559 (1974); J. Mann, *Transactions of the Institute of Metal Finishing*, 56, (2) 70 (1978), and H. L. Pinkerton et al, *Plating*, 59, 672 (1972)). Although periodic reversal of current works well with copper consumable anodes, with some types of nonconsumable anodes the reverse current tends to limit the lifetime of the anode.

SUMMARY OF THE INVENTION

The invention is a copper electroplating process with periodic current reversal in which a dual anode system is used so that during the plating part of the cycle a metal-oxide electrode is connected to the electrical power source and during the reversal part of the cycle, a chemically inert electrode is made part of the electroplating system. In this way, the metal-oxide electrode is not exposed to cathodic pulses which may reduce its lifetime. Switching between metal-oxide electrodes and inert electrodes may be accomplished in a number of ways including diode arrays, relays, timeoperated switches, etc. Such an electroplating procedure for copper produces the high quality copper usually obtained with a periodic reversal process without reducing the lifetime of the metal-oxide anode.

DETAILED DESCRIPTION

Figure 1:
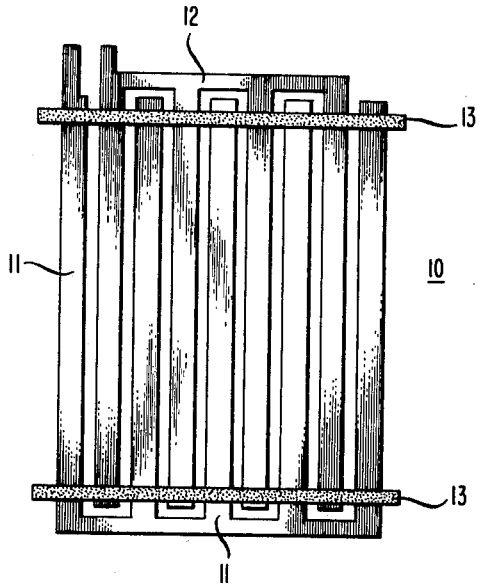
FIG. 1 shows a typical dual electrode arrangement useful in the practice of the invention.

The invention is based on the realization that the quality of copper electroplating in a nonconsumable process is improved by periodic reversal of the plating current and the metal-oxide anode could be protected from the detrimental effects of the reversing current by switching the current from the metal-oxide electrode to a chemically inert (or even copper) electrode. Discussed below are the various components of the electroplating process and several embodiments of the invention.

The bath used in the practice of the invention is conventional. Generally, the bath contains copper in some soluble form, conducting material to increase the conductivity of the bath and sometimes other ingredients to improve throwing power. Usually, additives to improve the quality of plating are left out since the periodic reversal of current serves this function. However, at times, various additives might be included even with periodic reversal of current.

A variety of copper electroplating baths is described in a book entitled *Modern Electroplating*, edited by F. A. Lowenheim, John Wiley and Sons, Inc., New York, especially Chapter 7 by A. K. Graham, W. H. Satranek and J. W. Dini.

Copper fluoborate baths are used to electroplate copper. The bath generally contains, in addition to additives discussed below, copper ion often added in the form of copper fluoborate and fluoboric acid. Boric acid is also added in many cases. The concentration of the various ingredients is not critical. Typical concentrations are: copper fluoborate 200–500 gms/liter;

fluoboric acid 10–40 gms/liter and boric acid 10–40 gms/liter.

Pyrophosphate baths are also useful. Such baths have a number of advantages. They have high throwing power, are not corrosive and are not toxic. Typical concentrations of constituents are copper ion ($Cu^{+2}$) 22–38 gms/liter, pyrophosphate $(P_2O_7)^{-4}$ 150–250 gms/liter, nitrate ion 5–10 gms/liter, ammonia 1–3 gms/liter and orthophosphate $(HPO_4)^{-2}$ no greater than 113 gms/liter.

Typical copper cyanide baths may also be used but considerable caution should be used since the anode side of the bath may become acidic, and rupture of the membrane may expose cyanide solution to acidic conditions, releasing poisonous HCN.

The preferred copper electroplating bath comprises copper sulfate in an acid solution. The concentration of copper and acid may vary over large limits. For copper, compositions generally vary from 0.05 Molar to saturation or, more preferably, from 0.05 to 1.5 Molar. Acid concentration varies from 0.1 to 2 Molar and is generally added as sulfuric acid.

Special bath compositions are used for special applications. For example, for high throwing power, it is preferred that the Molar acid concentration (generally as sulfuric acid) be at least 5 times the Molar concentration of copper ions. Plating results are often improved by the addition of chloride ions (generally in small amounts such as 30–100 mg/liter). The chloride ion is most conveniently added as hydrochloric acid.

Except for the anode system, the electroplating apparatus is conventional. For convenience, the electrodes are labeled as to their functions during the electroplating part of the cycle. The cathode is the workpiece on which copper electroplating occurs. This electrode together with the anode assembly is connected to a power supply which can be periodically reversed.

The anode assembly is made of two electrodes, one which has advantageous properties (e.g., low overvoltage) for use in copper electroplating (herein called the metal-oxide anode) and one that is chemically inert particularly for current reversal during the reverse part of the cycle (called herein the inert part of the cycle).

A large variety of electrodes may be used as the metal-oxide anode including electrodes usually used for copper electroplating and some more advanced electrode structures described in U.S. Pat. No. 4,269,670, issued to C. G. Smith on May 26, 1981 and U.S. Pat. No. 4,310,391, issued to Y. Okinaka et al on Jan. 12, 1982. These electrodes are generally made up of a substrate and a surface coating of various metal oxides and/or mixtures of metal oxides. Typically, the surface coating contains up to three groups of metal oxides. The first group is the group VIII metals comprising cobalt, nickel, ruthenium, rhodium, palladium, iridium, and platinum. The metal oxides of ruthenium and iridium are preferred because of good catalytic effect (generally measured by low electrode potential to electrolyze water) particularly at high current densities (say above 50 ASF). The second group is the oxides of valve metals, namely titanium, zirconium, hafnium, vanadium, niobium, and tantalum. The oxides of titanium, hafnium, niobium and tantalum are preferred with tantalum and hafnium most preferred. Generally, tantalum is preferred with iridium, and hafnium is preferred with ruthenium. The third group is the oxides of alkaline metals and rare earth metals (including group IIIB metals) such as beryllium, calcium, strontium, barium, scandium, yttrium, lanthanum and the rare earth elements with atomic numbers 58–71. For convenience, these metal oxides are referred to as binder metal oxides. The oxides of calcium, strontium, barium, scandium, and yttrium are preferred with barium and lanthanum most preferred because they yield electrodes of longest life under high current conditions. Barium is most preferred with the iridium-tantalum combination and lanthanum is most preferred with the ruthenium-hafnium combination. The composition of the active oxide coating may vary over large limits. Satisfactory results are obtained if the group VIII oxides are present to the extent of at least 10 mode percent, the valve metal oxides to the extent of at least 10 mole percent and the binder metal oxides to the extent of 0–50 mole percent. Preferred compositions are with the mole ratio of group VIII metal oxide to valve metal oxide between ½ and 4 and the range of binder metal oxide is from 5 to 50 mole percent. Most preferred is the range from 5 to 20 mole percent.

For copper electroplating under certain conditions (usually high electroplating rates), a surface coating of iridium oxide and tantalum oxide yields excellent results. Usually, the surface comprises 20 to 90 mole percent oxide of iridium, remainder oxide of tantalum. It is believed that much of the beneficial effects of this composition (and perhaps other compositions set forth above) including longer electrode life, lower potential and electrode stability, result from the formation of a mixed oxide of iridium and tantalum such as $Ir(TaO_3)_4$.

The chemically inert anode is made up of any material that is compatible with the copper electroplating process and is not adversely affected by the reversal current. Typically, a metal (even copper) is used which is not adversely affected by the copper electroplating solution. It should not corrode under conditions of the electroplating process and should be electrically conducting. (It should be remembered that usually copper will plate out on the inert electrode during the current reversal.) Titanium and tantalum are examples with titanium preferred because of inertness under conditions of the electroplating, low cost and availability.

A typical anode assembly is shown in FIG. 1. The anode assembly is made up of two electrodes, one a metal oxide electrode, 11, and the other an inert electrode, 12. The metal oxide electrode has a surface made up of iridium oxide and tantalum oxide. The inert electrode, 12, is made of titanium. The electrode assembly is held together by two dielectric spacers, 13. The entire anode assembly is typically immersed in the plating solution and located generally where the traditional anode is found.

The time sequence of the periodic reversal cycle may vary over large limits. For convenience, a symmetric cycling regime may be used as, for example, the use of AC current, etc. However, this does not lead to maximum efficiency and it is more usual to have the plating part of the cycle of greater duration than the deplating part of the cycle. Typically, the total quantity of electric charge involved in the plating part of the cycle (plating mode) is from 2–200 times the amount of charge involved in the deplating part of the cycle (deplating mode). Typically the plating part of the cycle may last between 0.1–500 seconds and the deplating part of the cycle from 0.5–50 seconds. Preferred is a plating cycle lasting from 10–60 seconds and a deplating cycle lasting from 1–5 seconds.

Figure 2:
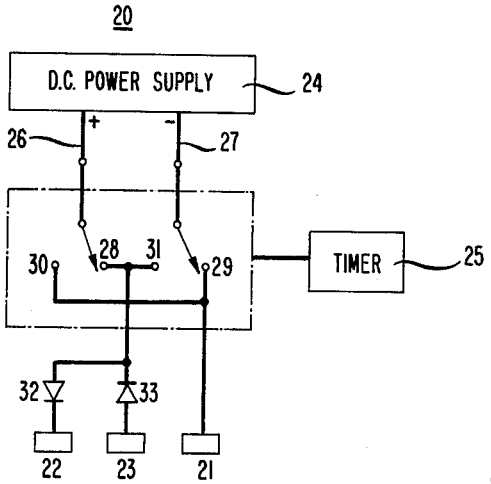
FIG. 2 shows a typical electrical set-up useful for switching from metal-oxide electrode to inert electrode in accordance with the invention.

Various arrangements may be used to insure that the metal oxide electrode is connected only during the plating part of the cycle and the inert electrode only during the deplating part of the cycle. FIG. 2 shows an exemplary apparatus, 20, for doing this with a diode arrangement. Shown are three electrodes, the cathode, 21, the metal-oxide electrodes, 22, and the inert electrode, 23. The electrodes are powered by a dc power supply, 24, and the switching is accomplished with a timer, 25, which switches the power supply leads, 26 and 27, from one set of terminals, 28 and 29, to another set of terminals, 30 and 31. The diodes, 32 and 33, are arranged in such a way that current passes into the metal-oxide electrode only during the plating part of the cycle when the positive electrode of the power supply is connected to terminal, 28, and passes current into the inert part of the electrode only during the deplating part of the cycle.

Figure 3:
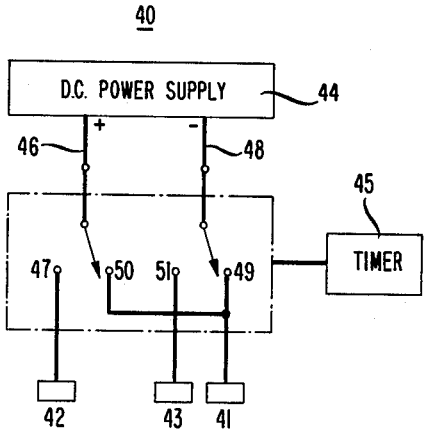
FIG. 3 shows another electrical set-up useful for switching from metal-oxide electrode to inert electrode in accordance with the invention.

Another experimental setup, 40, which accomplished the same purpose as above but by using relays is shown in FIG. 3. The electrodes are immersed in the electroplating bath. These electrodes include cathode, 41, metal-oxide electrode, 42, and inert electrode, 43. A power supply, 44, is used to supply energy for the electroplating process. Relays are switched back and forth between the lead shown using a timer, 45. During the deplating part of the cycle the positive power supply lead, 46, is connected to a terminal, 47, which leads to the metal-oxide electrode. During this part of the cycle, the negative lead from the power supply, 48, is connected directly to the cathode through terminal, 49. During the deplating part of the cycle, the relay is set in such a way that the positive power supply lead, 46, is connected through terminal, 50, to the cathode and the negative lead from the power supply, 48, is connected through terminal, 51, to the inert electrode. In this way, the current going through the plating apparatus can be periodically reversed so as to improve the quality of the copper plating.

Tests were carried out to determine the improvement in lifetime by use of this dual anode assembly. Using a single anode with an iridium oxidetantalum oxide coating and a periodic reverse cycle with 30 second plating and 2 second deplating, the anode lifetime is less than 24 hours. Using a dual anode setup, as shown in FIG. 2, the metal oxide anode lasted for 3,670 hours. With relay isolation as shown in FIG. 3, the metal-oxide anode lasted for more than 7,000 hours. Thus, use of the invention permits rapid copper electroplating with high quality and without the use of additives through periodic reversal of the plating current and this periodic reversal by use of the dual anode system does not significantly diminish the useful life of the metal-oxide anode.

What is claimed is:

1. A process for electroplating copper using periodic reversing of the electroplating current comprising the step of passing current through a cathode, electroplating solution and nonconsumable dual anode system using a source of current which is periodically reversed in direction from a plating mode to a deplating mode characterized in that the nonconsumable dual anode system comprises metal-oxide anode which is electrically connected to the source of current during the plating mode and chemically inert anode which is connected to the source of current during the deplating mode.

2. The process of claim 1 in which the electroplating bath comprises copper sulfate in acid solution.

3. The process of claim 2 in which the electroplating bath is made acidic with sulfuric acid and the copper concentration is between 0.05 Molar and saturation.

4. The process of claim 3 in which the concentration of copper is between 0.05 and 1.5 Molar and the concentration of sulfuric acid is between 0.1 and 2 Molar.

5. The process of claim 4 in which the electroplating bath contains chloride ions in a concentration range from 30–100 mg/liter.

6. The process of claim 1 in which the surface of the metal-oxide electrode comprises oxide of:

a. at least 10 mole percent group VIII metal, said group VIII metal selected from the group consisting of cobalt, nickel, rithenium, rhodium, palladium, iridium and platinum;

b. at least 10 mole percent valve metal, said valve metal selected from the group consisting of titanium, zirconium, hafnium, niobium and tantalum; and c. from 0–20 mole percent binder metal, said binder metal selected from the group consisting of beryllium, calcium, strontium, carium, scandium, yttrium, lanthanum and the rare earth elements with atomic numbers 58–71.

7. The process of claim 6 in which the surface of the metal-oxide electrode comprises 20–90 mole percent oxide of iridium, remainder oxide of tantalum.

8. The process of claim 1 in which the chemically inert electrode comprises electrically conducting material.

9. The process of claim 8 in which the chemically inert anode comprises metallic material.

10. The process of claim 9 in which the metallic material is selected from the group consisting of titanium and tantalum.

11. The process of claim 1 in which the plating mode is from 0.1–500 seconds in duration and the total quantity of electrical charge involved in the plating mode is from 2–200 times the amount of charge involved in the deplating mode.

* * * * *